US010638220B2

(12) United States Patent
Cao et al.

(10) Patent No.: US 10,638,220 B2
(45) Date of Patent: Apr. 28, 2020

(54) MOVING-COIL LOUDSPEAKER

(71) Applicant: Goertek Inc., Shandong (CN)

(72) Inventors: Huixian Cao, Shandong (CN); Shu Jiang, Shandong (CN); Xinfeng Yang, Shandong (CN)

(73) Assignee: Goertek, Inc., Weifang (CN)

( * ) Notice: Subject to any disclaimer, the term of this patent is extended or adjusted under 35 U.S.C. 154(b) by 0 days.

(21) Appl. No.: 16/329,197

(22) PCT Filed: Dec. 20, 2016

(86) PCT No.: PCT/CN2016/111128
§ 371 (c)(1),
(2) Date: Feb. 27, 2019

(87) PCT Pub. No.: WO2018/040396
PCT Pub. Date: Mar. 8, 2018

(65) Prior Publication Data

US 2019/0253808 A1 Aug. 15, 2019

(30) Foreign Application Priority Data

Aug. 31, 2016 (CN) ..... 2016 1 0790739

(51) Int. Cl.
*H04R 3/00* (2006.01)
*H04R 1/06* (2006.01)
(Continued)

(52) U.S. Cl.
CPC ..... *H04R 3/002* (2013.01); *H04R 1/06* (2013.01); *H04R 3/007* (2013.01); *H04R 9/025* (2013.01);
(Continued)

(58) Field of Classification Search
CPC ... H04R 1/06; H04R 7/04; H04R 7/06; H04R 7/10; H04R 7/125; H04R 7/16;
(Continued)

(56) References Cited

U.S. PATENT DOCUMENTS 2,968,695 A * 1/1961 Corliss ..... H04R 3/002 381/96
2012/0177215 A1* 7/2012 Bose ..... G01D 5/2417 381/74
(Continued)

FOREIGN PATENT DOCUMENTS

CN 104780489 A 7/2015
CN 204948356 U 1/2016
(Continued)

OTHER PUBLICATIONS

International Search Report and Written Opinion of applicatio No. PCT/CN2016/111128, dated Mar. 1, 2017 (10 pages including English Translation).

*Primary Examiner* — Jesse A Elbin
(74) *Attorney, Agent, or Firm* — Patent Law Works LLP

(57) ABSTRACT

A moving-coil loudspeaker is provided, comprising a vibration system and a magnetic circuit system located below the vibration system; the vibration system including a diaphragm, a spider, and a voice coil, the diaphragm comprising a diaphragm body part and a diaphragm reinforcing part; and the magnetic circuit system including a center washer, a center magnet, and a magnetic yoke; wherein the diaphragm reinforcing part comprises a first conductive material layer, the spider comprises a second conductive material layer, and the diaphragm reinforcing part and the spider are bonded by a conductive adhesive which establishes electrically connection between the first and second conductive material layers; and wherein the first and second conductive material layers functioning as a movable plate, and the center washer,
(Continued)

the center magnet, and the magnetic yoke functioning as a fixed plate constitute a capacitor structure for detecting a vibration displacement of the moving-coil loudspeaker.

14 Claims, 4 Drawing Sheets

(51) Int. Cl.

| | |
|---|---|
| ***H04R 9/02*** | (2006.01) |
| ***H04R 9/04*** | (2006.01) |
| ***H04R 7/06*** | (2006.01) |
| ***H04R 7/12*** | (2006.01) |
| ***H04R 7/10*** | (2006.01) |
| ***H04R 7/18*** | (2006.01) |
| ***H04R 7/24*** | (2006.01) |
| ***H04R 7/20*** | (2006.01) |
| ***H04R 29/00*** | (2006.01) |
| ***H04R 9/06*** | (2006.01) |

(52) U.S. Cl.
CPC ..... *H04R 9/04* (2013.01); *H04R 7/06* (2013.01); *H04R 7/10* (2013.01); *H04R 7/125* (2013.01); *H04R 7/18* (2013.01); *H04R 7/20* (2013.01); *H04R 7/24* (2013.01); *H04R 9/06* (2013.01); *H04R 29/003* (2013.01); *H04R 2307/027* (2013.01); *H04R 2400/11* (2013.01); *H04R 2499/11* (2013.01)

(58) Field of Classification Search
CPC ..... H04R 9/025; H04R 9/04; H04R 2499/11; H04R 3/002; H04R 3/007; H04R 7/18; H04R 7/20; H04R 7/24; H04R 29/003; H04R 2307/027
USPC ..... 381/400, 403, 410, 412, 421, 423, 430, 381/431, 404, 409, 420, 427, 398, 399
See application file for complete search history.

(56) References Cited

U.S. PATENT DOCUMENTS

| | | | | |
|---|---|---|---|---|
| 2016/0094917 | A1* | 3/2016 | Wilk | H04R 3/007 381/398 |
| 2016/0173990 | A1* | 6/2016 | Park | H04R 1/06 |
| 2016/0241957 | A1 | 8/2016 | Hogan et al. | |
| 2017/0245057 | A1* | 8/2017 | Grazian | H04R 7/125 |
| 2018/0063634 | A1* | 3/2018 | Dave | H04R 1/025 |
| 2018/0139551 | A1* | 5/2018 | Reining | H04R 7/10 |
| 2019/0261093 | A1* | 8/2019 | Salvatti | H04R 1/06 |

FOREIGN PATENT DOCUMENTS

| | | | |
|---|---|---|---|
| CN | 105657614 | A | 6/2016 |
| CN | 106162470 | A | 11/2016 |
| CN | 106211000 | A | 12/2016 |
| CN | 106231513 | A | 12/2016 |

* cited by examiner

MOVING-COIL LOUDSPEAKER

CROSS-REFERENCE TO RELATED APPLICATIONS

This application is a National Stage of International Application No. PCT/CN2016/111128, filed on Dec. 20, 2016, which claims priority to Chinese Patent Application No. 201610790739.6, filed on Aug. 31, 2016, both of which are hereby incorporated by reference in their entireties.

FIELD OF THE INVENTION

The present disclosure relates to an electroacoustic conversion device, and more particularly to a moving-coil loudspeaker.

BACKGROUND OF THE INVENTION

In the prior art, when a loudspeaker operates with a low-frequency, a main reason to limit a maximum power application of the product is as following:

A voice coil is likely to be displaced excessively by a high power when operating with the low-frequency. The excessive displacement may cause a significant distortion, even a substantial collision between the voice coil and a magnetic circuit system, such that the loudspeaker will be irreversibly damaged.

Currently, a solution to this problem is to implement an intelligent power amplifier control unit to control and feed back the power of the loudspeaker product. When an vibration displacement of the loudspeaker exceeds a predetermined level, the power are to be decreased. Consequently, the vibration displacement are required to be known. In the prior art, the voice coil of the loudspeaker and an external circuit can be used as a sensor, the monitoring of the vibration displacement of the loudspeaker is realized by the real-time measurement of a loudspeaker model and the real-time monitoring of an input signal. This solution can be carried out provided that the loudspeaker has a theoretical model with reference to the stiffness coefficient Kms of a diaphragm, the mass Mms of a vibration system, the factor of motive power and electricity Bl, the damping factor Rms, the DC resistance Re, the inductance Le, and the like.

However, the theoretical model of the loudspeaker still has some difference with the actual product, leading to limited accuracy on monitoring the displacement of the loudspeaker, such that the low-frequency performance of the loudspeaker is restricted, and the performance optimization of the loudspeaker operating with the low-frequency and the high power is affected.

SUMMARY OF THE INVENTION

One object of this disclosure is to provide a moving-coil loudspeaker configured with a capacitor structure for detecting a vibration displacement of the moving-coil loudspeaker.

According to a first aspect of the present disclosure, there is provided a moving-coil loudspeaker comprising a vibration system and a magnetic circuit system located below the vibration system.

The vibration system includes a diaphragm, a spider, and a voice coil combined one on top of the other, the diaphragm comprising a diaphragm body part with a surround portion and a diaphragm reinforcing part combined with the diaphragm body part at a lower central location of the diaphragm body part. The diaphragm reinforcing part comprises a first conductive material layer, the spider comprises a second conductive material layer, and the diaphragm reinforcing part and the spider are bonded by a conductive adhesive which establishes electrically connection between the first and second conductive material layers.

The magnetic circuit system including a center washer, a center magnet, and a magnetic yoke combined one on top of the other.

The first and second conductive material layers functioning as a movable plate, and the center washer, the center magnet, and the magnetic yoke functioning as a fixed plate constitute a capacitor structure for detecting a vibration displacement of the moving-coil loudspeaker.

Optionally, the magnetic yoke is a basin-shaped frame, the fixed plate being connected to an external circuit via the base of the basin-shaped frame.

Optionally, the center washer, the center magnet and the magnetic yoke are adhesively secured by a conductive adhesive or an insulative adhesive.

According to a second aspect of the present disclosure, there is provided a moving-coil loudspeaker comprising a front cover, a vibration system, and a magnetic circuit system arranged one on top of the other.

The front cover includes a third conductive material layer.

The vibration system including a diaphragm, a spider, and a voice coil combined one on top of the other, the diaphragm comprising a diaphragm body part with a surround portion and a diaphragm reinforcing part combined with the diaphragm body part at a lower central location of the diaphragm body part. The diaphragm reinforcing part comprises a first conductive material layer, the spider comprises a second conductive material layer, and the diaphragm reinforcing part and the spider are bonded by a conductive adhesive which establishes electrically connection between the first and second conductive material layers.

The magnetic circuit system including a center washer, a center magnet, and a magnetic yoke combined one on top of the other.

The first and second conductive material layers functioning as a movable plate, and the third conductive material layer functioning as a fixed plate constitute a capacitor structure for detecting a vibration displacement of the moving-coil loudspeaker.

Optionally, a front cover bonding pad is provided on the front cover, a connection terminal is provided on the front cover bonding pad, and the fixed plate is connected to an external circuit via the connection terminal.

Optionally, the spider is a Flexible Printed Circuit Board

Optionally, the movable plate is connected to an external circuit via the spider.

Optionally, the spider has a central hollow portion.

Optionally, the first conductive material layer has an area larger than that of the second conductive material layer.

Optionally, the moving-coil loudspeaker further comprises a housing accommodating the vibration system and the magnetic circuit system, with an edge of the spider being fixed to the housing.

In the moving-coil loudspeaker of the present disclosure, the capacitor structure for detecting the actual vibration displacement of the vibration system is provided, and the vibration displacement of the moving-coil loudspeaker is detected in a real time and accurate manner by utilizing the capacitor structure.

Further features of the present disclosure and advantages thereof will become apparent from the following detailed description of exemplary embodiments according to the present disclosure with reference to the attached drawings.

BRIEF DESCRIPTION OF THE DRAWINGS

The accompanying drawings, which are incorporated in and constitute a part of the specification, illustrate embodiments of the disclosure and, together with the description thereof, serve to explain the principles of the disclosure.

DETAILED DESCRIPTION OF THE EMBODIMENTS

Figure 1:
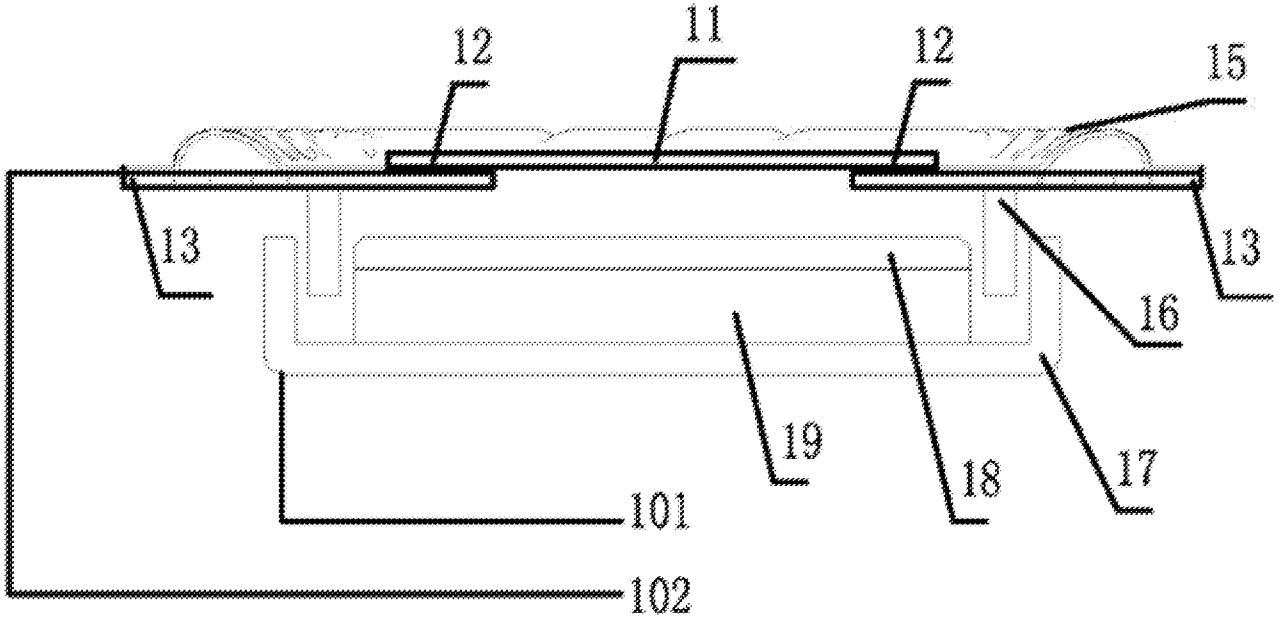
FIG. 1 is a schematic cross-sectional view of a moving coil loudspeaker according to a first embodiment of the present disclosure.

Various exemplary embodiments of the present disclosure will now be described in detail with reference to the drawings. It should be noted that the relative arrangement of the components and steps, the numerical expressions, and numerical values set forth in these embodiments do not limit the scope of the present disclosure unless it is specifically stated otherwise.

The following description of at least one exemplary embodiment is merely illustrative in nature and is in no way intended to limit the disclosure, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

It should be noted at first that the terms "below", "one on top of the other", "upper surface", "lower surface" and the like in the present disclosure merely indicate a relative positional relationship between components of a loudspeaker. When the loudspeaker is flipped or rotated, the relative positional relationship may be reversed or changed.

A moving-coil loudspeaker generally comprises a vibration system, a magnetic circuit system, and a housing accommodating the vibration system and the magnetic circuit system. The vibration system includes a diaphragm and a voice coil combined on one side of the diaphragm. The magnetic circuit system generally comprises a washer, a magnet, and a magnetic yoke. The voice coil is suspended in a magnetic gap formed by the magnetic circuit system. The diaphragm generally comprises a diaphragm body part and a diaphragm body part combined on one side of the diaphragm reinforcing part. The diaphragm body part generally has a surround portion, a periphery of the surround portion being provided with a fixing portion for fixing the housing. The diaphragm reinforcing part can be, for example, a DOME. The magnetic circuit system can be a twin magnetic circuit system, in which a magnet comprises a center magnet provided at a center location of a magnetic yoke and an edge magnet embracing the center magnet, and a washer comprises a center washer corresponding to the center magnet and an edge washer embracing the center washer. An integrated structure of the center magnet and center washer forms a magnetic gap with an integrated structure of the edge magnet and edge washer, with a voice coil being provided in the magnetic gap. Alternatively, the magnetic yoke can have a basin-shaped frame. The base of the basin-shaped frame has a central location provided with a center magnet, and a center washer is provided corresponding to the center magnet. An integrated structure of the center magnet and center washer forms a magnetic gap with the basin-shaped frame, with a voice coil being provided in the magnetic gap.

A capacitor structure is designed by the present disclosure to detect an actual vibration displacement of the moving-coil loudspeaker vibration system. The capacitor structure is constituted by a movable plate and a fixed plate opposed to the movable plate, in which the movable plate as a part of the vibration system is vibrated therewith. When the vibration system vibrates, a change in a distance between the movable plate and fixed plate arises, resulting in a change in a capacitance value of the capacitor. Consequently, the actual vibration displacement of the vibration system can be calculated by monitoring the change in the capacitance value of the capacitor or a change in a current of a circuit connected to the capacitor.

First Embodiment

A configuration of a moving coil loudspeaker according to the first embodiment of the present disclosure is illustrated with reference to FIG. 1.

The moving-coil loudspeaker comprises a vibration system, a magnetic circuit system located below the vibration system, and a housing accommodating the vibration system and the magnetic circuit system.

The vibration system comprises a diaphragm, a spider 13, and a voice coil 16 combined one on top of the other. The diaphragm comprises a diaphragm body part 15 with a surround portion and a diaphragm reinforcing part 11 combined with the diaphragm body part 15 at a lower central location of the diaphragm body part. The spider 13 has a central hollow portion, and an edge of the spider 13 is fixed with the housing. The diaphragm reinforcing part 11 comprises a first conductive material layer, and the spider 13 comprises a second conductive material layer. The diaphragm reinforcing part 11 and spider 13 are bonded by a conductive adhesive 12, and the conductive adhesive 12 establishes electrically connection between the first and second conductive material layers. Preferably, the diaphragm reinforcing part 11 as a whole can be manufactured by a conductive material, for example, the diaphragm reinforcing part 11 is manufactured by metal.

The magnetic circuit system comprises a center washer 18, a center magnet 19, and a basin-shaped frame 17 combined one on top of the other, all of which are bonded together by a conductive adhesive.

The first and second conductive material layers jointly functioning as a movable plate, and the center washer 18, the center magnet 19, and the basin-shaped frame 17 jointly functioning as a fixed plate constitute a capacitor structure for detecting a vibration displacement of the moving-coil loudspeaker.

As the spider 13 is generally hollow, the second conductive material layer has a relatively small area, thus if only the second conductive material layer is made as the movable plate, the constituted capacitor structure would have a very low capacitance and hence be insensitive during detection. In the embodiment, the diaphragm reinforcing part 11 has the first conductive material layer. As the conductive adhesive 12 establishes electrically connection between the first and second conductive material layers, an area of the movable plate is increased by being constituted by both the first and second conductive material layers, thus improving the capacitance and sensitivity of the capacitor structure.

When the energized voice coil 16 is vibrated under an action of the magnetic circuit system, the voice coil 16 would bring the diaphragm and spider 13 to vibrate together, thus causing a change in a capacitance value of the capacitor formed by the movable plate and fixed plate. Consequently, the actual displacement of the vibration system can be calculated by monitoring the change in the capacitance value of the capacitor, or by indirectly monitoring a change in a current of a circuit connected to the capacitor. It is possible to connect an intelligent power amplifier control unit with the capacitor, so as to monitor the actual displacement of the vibration system and decrease an input power to the moving-coil loudspeaker when necessary, thus protecting the moving-coil loudspeaker from being distorted excessively or physical damaged.

As the center washer 18, the center magnet 19, and the basin-shaped frame 17 are conductive, a lead wire 101 can be led from the base of the basin-shaped frame 17, such that the fixed plate can be connected to an external circuit via the base of the basin-shaped frame 17. As the spider 13 is a Flexible Printed Circuit Board, a lead wire 102 can be led from an edge of the spider 13, such that the movable plate can be connected to the ground or the external circuit via the spider 13, and a chip for detecting capacitance values can be provided on the Flexible Printed Circuit Board.

In this embodiment, the spider has multiple functions, so as to reduce components required by the loudspeaker product and hence the cost, and reduce the space requirement for the designed product. Particularly, one hand, the spider itself on has a function of maintaining a concentric vibration of vibration components of the vibration system to decrease polarization. On the other hand, the spider as a part of the movable plate can be used to detect the vibration displacement of the vibration system. In the mean while, the spider as an electrical connection structure can feed back an electrical signal of the capacitance value to an external detection system.

In the embodiment, while meeting the design requirement of the movable plate of the capacitive sensor, more adjustable items are introduced for the acoustic performance adjustment of the loudspeaker. Particularly, the acoustic performance of the loudspeaker can be adjusted by selecting different materials for the diaphragm reinforcing part, especially in the high frequency range. Also, the acoustic performance of the loudspeaker can be adjusted by designing the size of the central hollow portion of the spider.

In another embodiment, the magnetic circuit system can be the twin magnetic circuit system as mentioned above. The center washer, center magnet, and magnetic yoke which are closest to the vibration system are used as fixed plate.

Second Embodiment

Figure 2:
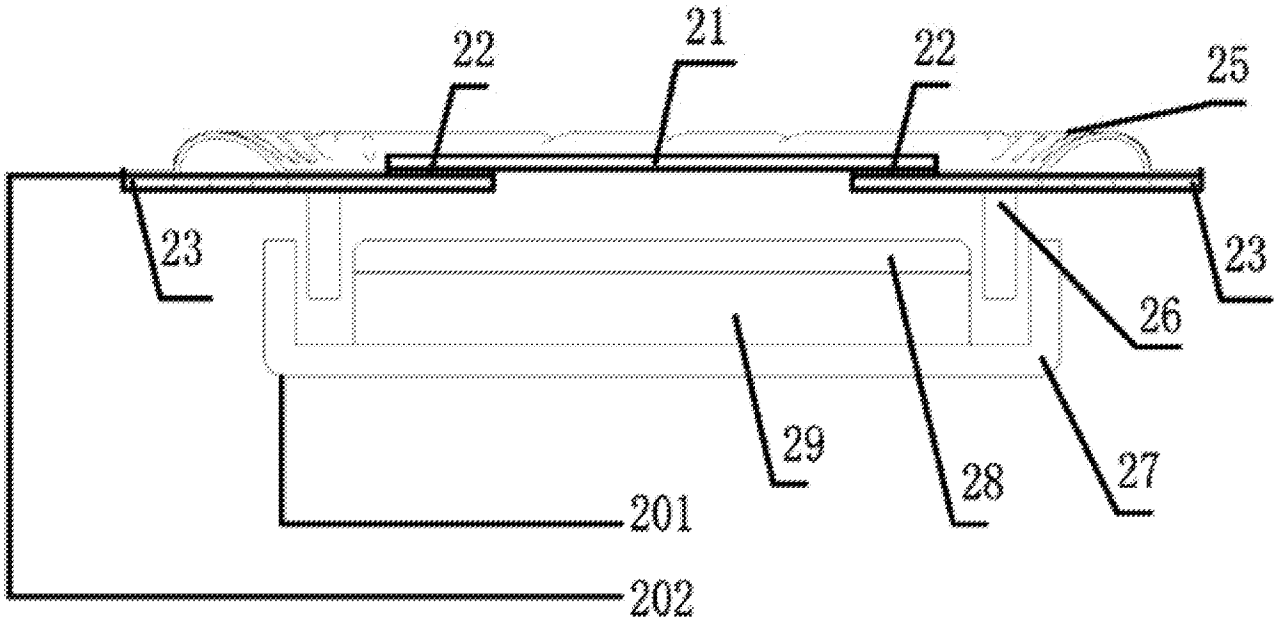
FIG. 2 is a cross-sectional view showing a moving coil loudspeaker according to a second embodiment of the present disclosure.

A configuration of a moving coil loudspeaker according to the second embodiment of the present disclosure is illustrated with reference to FIG. 2.

The moving-coil loudspeaker comprises a vibration system, a magnetic circuit system located below the vibration system, and a housing accommodating the vibration system and the magnetic circuit system.

The vibration system comprises a diaphragm, a spider 23, and a voice coil 26 combined one on top of the other. The diaphragm comprises a diaphragm body part 25 with a surround portion and a diaphragm reinforcing part 21 arranged below a central location of the diaphragm body part 25. The spider 23 has a central hollow portion, and an edge of the spider 23 is fixed with the housing. The diaphragm reinforcing part 21 comprises a first conductive material layer, and the spider 23 comprises a second conductive material layer. The diaphragm reinforcing part 21 and spider 23 are bonded together by an insulative adhesive 22. Preferably, the diaphragm reinforcing part 21 as a whole can be manufactured by a conductive material, for example, the diaphragm reinforcing part 21 is manufactured by metal.

The magnetic circuit system comprises a center washer 28, a center magnet 29, and a basin-shaped frame 27 combined one on top of the other, all of which are bonded together by a conductive adhesive.

The first and second conductive material layers functioning as a movable plate, and the center washer 28, the center magnet 29, and the basin-shaped frame 27 functioning as a fixed plate constitute a capacitor structure for detecting a vibration displacement of the moving-coil loudspeaker.

As the spider 23 is generally hollow, the second conductive material layer has a relatively small area, thus if only the second conductive material layer is made as the movable plate, the constituted capacitor structure would have a very low capacitance and hence be insensitive during detection. In the embodiment, the diaphragm reinforcing part 21 has the first conductive material layer, the first and second conductive material layers are jointly used as the movable plate. It is known from the basic principle of capacitance that although the diaphragm reinforcing part 21 and the spider 23 are not electrically connected, the capacitance of the capacitor structure is relatively high due to a close distance between the diaphragm reinforcing part 21 and the spider 23 and a relative large area of the first conductive material layer. After tested by practice, it is found that the capacitor structure is very sensitive so that the requirement for detecting the vibration displacement of the loudspeaker is well met.

As the center washer 28, the center magnet 29, and the basin-shaped frame 27 are conductive, a lead wire 201 can be led from the base of the basin-shaped frame 27, such that the fixed plate can be connected to an external circuit via the base of the basin-shaped frame 27. As the spider 23 is a Flexible Printed Circuit Board, a lead wire 202 can be led from an edge of the spider 23, such that the movable plate can be connected to the ground or the external circuit via the spider 23, and a chip for detecting capacitance values can be provided on the Flexible Printed Circuit Board.

In the embodiment, the spider has multiple functions, so as to reduce components required by the loudspeaker product and hence the cost, and reduce the space requirement for the designed product. Particularly, the spider itself on one hand has a function of maintaining a concentric vibration of vibration components of the vibration system to decrease polarization. On the other hand, the spider as a part of the movable plate can be used to detect the vibration displacement of the vibration system. In the mean while, the spider as an electrical connection structure can feed back an electrical signal of the capacitance value to an external detection system.

In the embodiment, while meeting the design requirement of the movable plate of the capacitive sensor, more adjustable items are introduced for the acoustic performance adjustment of the loudspeaker. Particularly, the acoustic performance of the loudspeaker can be adjusted by selecting different materials for the diaphragm reinforcing part, especially in the high frequency range. Also, the acoustic performance of the loudspeaker can be adjusted by designing the size of the central hollow portion of the spider.

In this embodiment, the insulative adhesive is chosen to bond the diaphragm reinforcing part with the spider, so a sensitive capacitor structure can also be realized, which renders this embodiment compatible with the first embodiment which utilizes the conductive adhesive. Therefore, options in selecting adhesives are increased.

Third Embodiment

Figure 3:
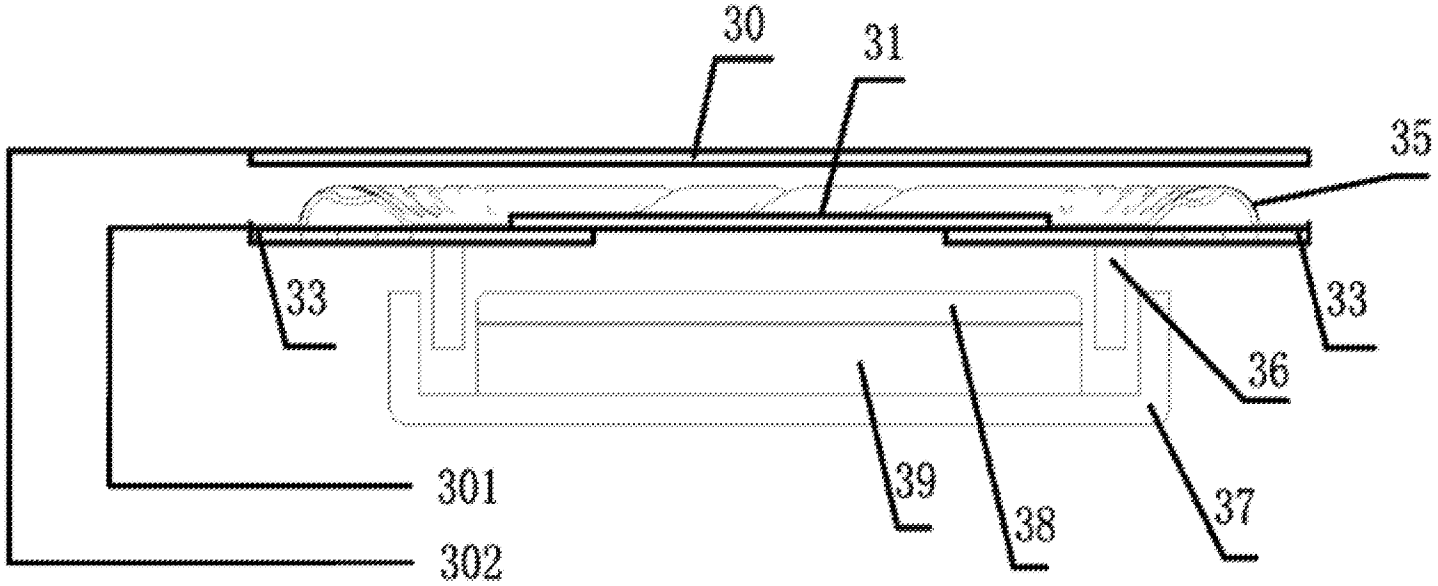
FIG. 3 is a cross-sectional view showing a moving coil loudspeaker according to a third embodiment of the present disclosure.

A configuration of a moving coil loudspeaker according to the third embodiment of the present disclosure is illustrated with reference to FIG. 3.

The moving-coil loudspeaker comprises a front cover, a vibration system, and a magnetic circuit system arranged one on top of the other, and a housing combined with the front cover.

The vibration system comprises a diaphragm, a spider 33, and a voice coil 36 combined one on top of the other. The diaphragm comprises a diaphragm body part 35 with a surround portion and a diaphragm reinforcing part 31 arranged below a central location of the diaphragm body part 35. The spider 33 has a central hollow portion, and an edge of the spider 33 is fixed with the housing. The diaphragm reinforcing part 31 comprises a first conductive material layer, and the spider 33 comprises a second conductive material layer. The diaphragm reinforcing part 31 and spider 33 are bonded together. Preferably, the diaphragm reinforcing part 31 as a whole can be manufactured by a conductive material, for example, the diaphragm reinforcing part 31 is manufactured by metal.

The magnetic circuit system comprises a center washer 38, a center magnet 39, and a basin-shaped frame 37 combined one on top of the other.

The front cover comprises a third conductive material layer. That is, at least a part of the front cover is manufactured by a conductive material, for example, a lower surface of the front cover is a metal sheet 30. Optionally, the front cover as a whole is manufactured by a conductive material, for example, the overall front cover is a metal sheet.

The first and second conductive material layers jointly as the movable plate, and the third conductive material layer as the fixed plate constitute a capacitor structure for detecting a vibration displacement of the moving-coil loudspeaker.

The diaphragm reinforcing part 31 and spider 33 can be bonded by a conductive adhesive as in the first embodiment, so the conductive adhesive establishes electrically connection between the first and second conductive material layers. Alternatively, the diaphragm reinforcing part 31 and spider 33 can be bonded by an insulative adhesive as in the second embodiment.

In this embodiment, a front cover bonding pad can be provided on the front cover, a connection terminal can be provided on the front cover bonding pad, and a lead wire 302 is led from the connection terminal, thus connecting the fixed plate to an external circuit. As the spider 33 is an Flexible Printed Circuit Board, a lead wire 301 can be led from an edge of the spider 33, such that the movable plate can be connected to the ground or the external circuit via the spider 33, and a chip for detecting capacitance values can be provided on the Flexible Printed Circuit Board.

In this embodiment, the spider has multiple functions, so as to reduce components required by the loudspeaker product and hence the cost, and reduce the space requirement for the designed product. Particularly, the spider itself on one hand has a function of maintaining a concentric vibration of vibration components of the vibration system to decrease polarization. On the other hand, the spider as a part of the movable plate can be used to detect the vibration displacement of the vibration system. In the mean while, the spider as an electrical connection structure can feed back an electrical signal of the capacitance value to an external detection system.

In this embodiment, while meeting the design requirement of the movable plate of the capacitive sensor, more adjustable items are introduced for the acoustic performance adjustment of the loudspeaker. Particularly, the acoustic performance of the loudspeaker can be adjusted by selecting different materials for the diaphragm reinforcing part, especially in the high frequency range. Also, the acoustic performance of the loudspeaker can be adjusted by designing the size of the central hollow portion of the spider.

Forth Embodiment

Figure 4:
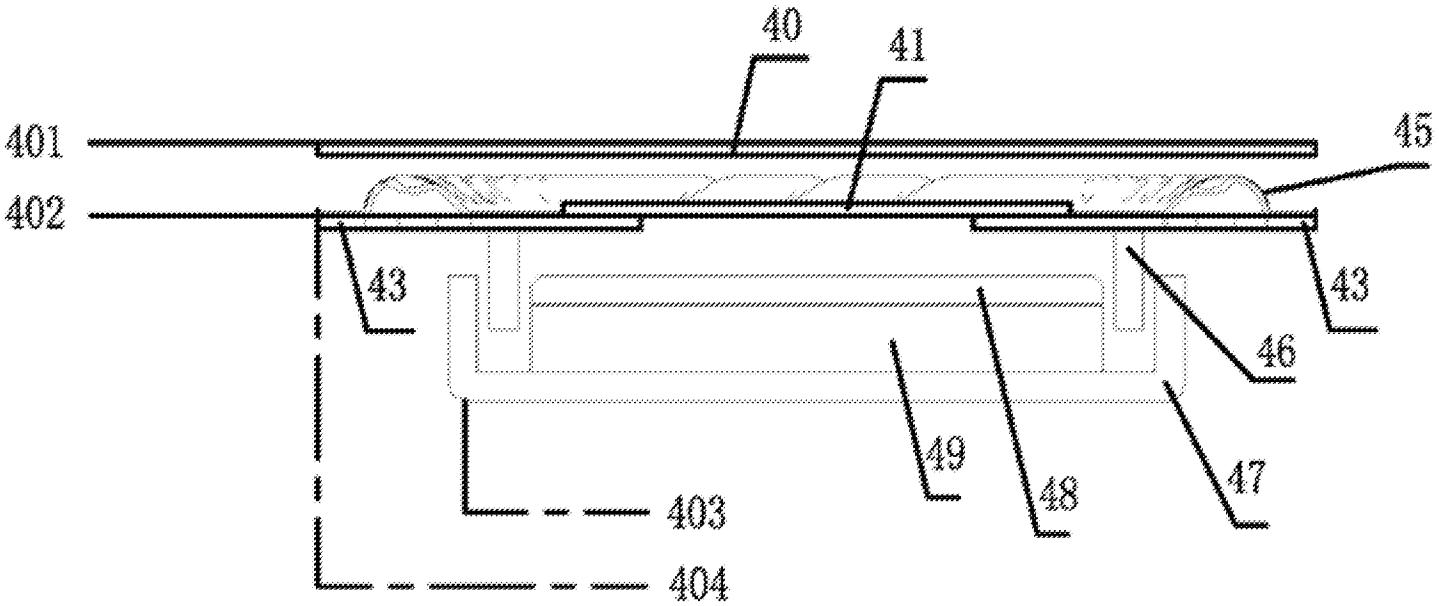
FIG. 4 is a cross-sectional view showing a moving coil loudspeaker according to a fourth embodiment of the present disclosure.

A configuration of a moving coil loudspeaker according to the forth embodiment of the present disclosure is illustrated with reference to FIG. 4.

The moving-coil loudspeaker comprises a front cover, a vibration system, and a magnetic circuit system arranged one on top of the other, and a housing combined with the front cover.

The vibration system comprises a diaphragm, a spider 43, and a voice coil 46 combined one on top of the other. The diaphragm comprises a diaphragm body part 45 with a surround portion and a diaphragm reinforcing part 41 arranged below a central location of the diaphragm body part 45. The spider 43 has a central hollow portion, and an edge of the spider 43 is fixed with the housing. The diaphragm reinforcing part 41 comprises a first conductive material layer, and the spider 43 comprises a second conductive material layer. The diaphragm reinforcing part 41 and spider 43 are bonded together. Preferably, the diaphragm reinforcing part 41 as a whole can be manufactured by a conductive material, for example, the diaphragm reinforcing part 41 is manufactured by metal.

The magnetic circuit system comprises a center washer 48, a center magnet 49, and a basin-shaped frame 47 bonded one on top of the other.

The front cover comprises a third conductive material layer. That is, at least a part of the front cover is manufactured by a conductive material, for example, a lower surface of the front cover is a metal sheet 40. Optionally, the front cover as a whole is manufactured by a conductive material, for example, the overall front cover is a metal sheet.

The first and second conductive material layers are jointly used as the movable plate, the third conductive material layer is used as a first fixed plate, and the center washer 48, the center magnet 49, and the basin-shaped frame 47 are jointly used as a second fixed plate. The first fixed plate, the movable plate, and the second fixed plate constitute a capacitor structure for detecting a vibration displacement of the moving-coil loudspeaker.

The diaphragm reinforcing part 41 and spider 43 can be bonded by a conductive adhesive as in the first embodiment, so the conductive adhesive establishes electrically connection between the first and second conductive material layers.

Alternatively, the diaphragm reinforcing part 41 and spider 43 can be bonded by an insulative adhesive as in the second embodiment.

In the embodiment, a front cover bonding pad can be provided on the front cover, a connection terminal can be provided on the front cover bonding pad, and a lead wire 401 is led from the connection terminal, thus connecting the first fixed plate to an external circuit.

As the center washer 48, the center magnet 49, and the basin-shaped frame 47 each are conductive, all of which are boned and electrically connected by the conductive adhesive. A lead wire 403 can be led from the basin-shaped frame 47, such that the second fixed plate can be connected to the external circuit via the base of the basin-shaped frame 47. In another embodiment, it is possible to use an insulative adhesive to bond the movable plate in a similar way, that is, the center washer 48, the center magnet 49, and the basin-shaped frame 47 are boned by the insulative adhesive, and still connected to the external circuit via the base of the basin-shaped frame 47.

As the spider 43 is a Flexible Printed Circuit Board, the movable plate can be connected to ground or the external circuit via the spider 43. Lead wires 402 and 404 can be led from an edge of the spider 43, such that a first capacitor structure formed by the first fixed plate and the movable plate can feed back a signal to the external circuit via the lead wire 401 and the lead wire 402, and second capacitor structure formed by the second fixed plate and the movable plate can feed back a signal to the external circuit via the lead wire 403 and the lead wire 404. A capacitance detection chip can be provided on the Flexible Printed Circuit Board.

In the embodiment, the spider has multiple functions, so as to reduce components required by the loudspeaker product and hence the cost, and reduce the space requirement for the designed product. Particularly, the spider itself on one hand has a function of maintaining a concentric vibration of vibration components of the vibration system to decrease polarization. On the other hand, the spider as a part of the movable plate can be used to detect the vibration displacement of the vibration system. In the mean while, the spider as an electrical connection structure can feed back an electrical signal of the capacitance value to an external detection system.

In the embodiment, while meeting the design requirement of the movable plate of the capacitive sensor, more adjustable items are introduced for the acoustic performance adjustment of the loudspeaker. Particularly, the acoustic performance of the loudspeaker can be adjusted by selecting different materials for the diaphragm reinforcing part, especially in the high frequency range. Also, the acoustic performance of the loudspeaker can be adjusted by designing the size of the central hollow portion of the spider.

In the embodiment, two fixed plate are designed to make the best of the structural characteristics of the loudspeaker and its system, further improving the sensitivity of the capacitor structure, increasing the space utilization, and facilitating the integration of the loudspeaker with other functional modules.

Although some specific embodiments of the present disclosure have been demonstrated in detail with examples, it should be understood by a person skilled in the art that the above examples are only intended to be illustrative but not to limit the scope of the present disclosure. It should be understood by those skilled in the art that the above embodiments could be modified without departing from the scope and spirit of the present disclosure. The scope of the present disclosure is defined by the appended claims.

The invention claimed is:

1. A moving-coil loudspeaker comprising:

a vibration system and a magnetic circuit system located below the vibration system;

the vibration system including a diaphragm, a spider, and a voice coil combined one on top of the other, the diaphragm comprising a diaphragm body part with a surround portion and a diaphragm reinforcing part combined with the diaphragm body part at a lower central location of the diaphragm body part; and the magnetic circuit system including a center washer, a center magnet, and a magnetic yoke combined one on top of the other;

wherein the diaphragm reinforcing part comprises a first conductive material layer, the spider comprises a second conductive material layer, and the diaphragm reinforcing part and the spider are bonded by a conductive adhesive which establishes an electrical connection between the first and second conductive material layers; and wherein the first and second conductive material layers functioning as a movable plate, and the center washer, the center magnet, and the magnetic yoke functioning as a fixed plate constitute a capacitor structure for detecting a vibration displacement of the moving-coil loudspeaker.

2. The moving-coil loudspeaker according to claim 1, wherein the magnetic yoke is a basin-shaped frame, the fixed plate being connected to an external circuit via a base of the basin-shaped frame.

3. The moving-coil loudspeaker according to claim 1, wherein the center washer, the center magnet and the magnetic yoke are adhesively secured by a conductive adhesive or an insulative adhesive.

4. The moving-coil loudspeaker according to claim 1, wherein the spider is a Flexible Printed Circuit Board.

5. The moving-coil loudspeaker according to claim 1, wherein the movable plate is connected to an external circuit via the spider.

6. The moving-coil loudspeaker according to claim 1, wherein the spider has a central hollow portion.

7. The moving-coil loudspeaker according to claim 1, wherein the first conductive material layer has an area larger than that of the second conductive material layer.

8. The moving-coil loudspeaker according to claim 1, further comprising a housing accommodating the vibration system and the magnetic circuit system, with an edge of the spider being fixed to the housing.

9. A moving-coil loudspeaker comprising:

a front cover, a vibration system, and a magnetic circuit system arranged one on top of the other;

the front cover including a third conductive material layer;

the vibration system including a diaphragm, a spider, and a voice coil combined one on top of the other, the diaphragm comprising a diaphragm body part with a surround portion and a diaphragm reinforcing part combined with the diaphragm body part at a lower central location of the diaphragm body part; and the magnetic circuit system including a center washer, a center magnet, and a magnetic yoke combined one on top of the other;

wherein the diaphragm reinforcing part comprises a first conductive material layer, the spider comprises a second conductive material layer, and the diaphragm reinforcing part and the spider are bonded by a conductive adhesive which establishes an electrical connection between the first and second conductive material layers; and wherein the first and second conductive material layers functioning as a movable plate, and the third conductive material layer functioning as a fixed plate constitute a capacitor structure for detecting a vibration displacement of the moving-coil loudspeaker.

10. The moving-coil loudspeaker according to claim 9, wherein a front cover bonding pad is provided on the front cover, a connection terminal is provided on the front cover bonding pad, and the fixed plate is connected to an external circuit via the connection terminal.

11. The moving-coil loudspeaker according to claim 9, wherein the spider is a Flexible Printed Circuit Board.

12. The moving-coil loudspeaker according to claim 9, wherein the movable plate is connected to an external circuit via the spider.

13. The moving-coil loudspeaker according to claim 9, wherein the spider has a central hollow portion.

14. The moving-coil loudspeaker according to claim 9, wherein the first conductive material layer has an area larger than that of the second conductive material layer.

* * * * *